US010224674B1

(12) United States Patent
Huang et al.

(10) Patent No.: US 10,224,674 B1
(45) Date of Patent: Mar. 5, 2019

(54) HIGH FREQUENCY CONNECTOR

(71) Applicant: SPEED TECH CORP., Taoyuan (TW)

(72) Inventors: Kuo-Hua Huang, Taoyuan (TW); I-Ting Hsieh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 15/811,644

(22) Filed: Nov. 13, 2017

(30) Foreign Application Priority Data

Aug. 8, 2017 (TW) ..... 106211787 U

(51) Int. Cl.

| | |
|---|---|
| ***H01R 13/6471*** | (2011.01) |
| ***H01R 13/6474*** | (2011.01) |
| ***H01R 13/6477*** | (2011.01) |
| ***H01R 12/71*** | (2011.01) |
| *H01R 12/70* | (2011.01) |

(52) U.S. Cl.
CPC ..... *H01R 13/6471* (2013.01); *H01R 12/716* (2013.01); *H01R 13/6474* (2013.01); *H01R 13/6477* (2013.01); *H01R 12/707* (2013.01)

(58) Field of Classification Search
CPC ..... H01R 13/6581; H01R 13/2421; H01R 13/6583; H01R 24/60; H01R 43/16; H01R 12/58; H01R 12/7082; H01R 12/712; H01R 12/79; H01R 13/04; H01R 13/17; H01R 13/2428; H01R 13/415; H01R 13/424
See application file for complete search history.

(56) References Cited

U.S. PATENT DOCUMENTS

| | | | | |
|---|---|---|---|---|
| 6,517,360 | B1 * | 2/2003 | Cohen | H01R 23/688 439/607.11 |
| 8,597,047 | B2 * | 12/2013 | Soubh | H01R 13/6584 439/485 |
| 8,926,367 | B2 * | 1/2015 | Hsu | H01R 13/658 439/607.35 |
| 2015/0087172 | A1 * | 3/2015 | Yu | H01R 13/6582 439/108 |
| 2015/0214684 | A1 * | 7/2015 | Chen | H01R 35/04 439/217 |
| 2015/0244111 | A1 * | 8/2015 | Ju | H01R 13/6585 439/607.05 |

(Continued)

FOREIGN PATENT DOCUMENTS

TW M332299 U 5/2008

*Primary Examiner* — Truc T Nguyen
(74) *Attorney, Agent, or Firm* — CKC & Partners Co., LLC

(57) ABSTRACT

A high frequency connector is disclosed. The high frequency connector includes an insulating housing, a plurality of insulating pieces, and a plurality of terminals. Each of the terminals is respectively assembled to the insulating pieces. The plurality of insulating pieces are assembled to the insulating housing. Each of the insulating pieces has a first surface and a second surface. A plurality of recesses are formed on each of the first surface and the second surface. The recesses are arranged in parallel on each of the first surface and the second surface. A plurality of impedance adjustment holes are arranged on each of the first surface and the second surface in an interlaced manner. The impedance adjustment holes are disposed between the recesses. Each of the terminals is received in the impedance adjustment hole or the recess, so as to improve characteristic impedances and crosstalk interferences of the terminals.

5 Claims, 9 Drawing Sheets

(56) References Cited

U.S. PATENT DOCUMENTS

| | | | | |
|---|---|---|---|---|
| 2015/0280375 | A1* | 10/2015 | Xu | H01R 13/6594<br>439/607.01 |
| 2016/0099524 | A1* | 4/2016 | Hack | H01R 13/6583<br>439/607.55 |

* cited by examiner

HIGH FREQUENCY CONNECTOR

RELATED APPLICATIONS

This application claims priority to Taiwan Application Serial Number 106211787, filed Aug. 8, 2017, which is herein incorporated by reference.

BACKGROUND

Field of Invention

The present invention relates to a connector that can be configured to transmit a high frequency electronic signal operating at a frequency up to millions of hertz (MHz).

Description of Related Art

A connector is a medium that exchanges electronic signals between different electronic devices. Various electronic devices establish an electrical connection through a connector matching one another, so that electronic signals between different electronic devices can be transmitted or exchanged. Owing to gradually increasing frequencies of electronic signals transmitted by the connectors and considerable sensitivity of electromagnetic fields in the space for the high frequency electronic signals, it is necessary to take effective isolation measures on the electromagnetic fields inside the connectors. Effective isolation measures on the electromagnetic fields can reduce interferences between most of the high frequency signals transmitted by the connectors and suppress noises of the high frequency electronic signals induced by the electromagnetic fields, thus facilitating the complete transmission of the high frequency electronic signals.

Prior arts relating to isolating mutual interferences between electromagnetic fields inside a connector at least include the Taiwan patent No. M332299. In order to facilitate the understanding of the technology disclosed in the present invention, the above relevant prior art should be referred to before trying to understand the disclosure of the present invention.

As shown in FIG. 9 to FIG. 11, the prior art Taiwanese patent No. M332299 discloses an electrical connector A10, more particularly relates to an electrical connector A10 being able to transmit high frequency signals. The electrical connector A10 comprises an insulating body A1, a plurality of conductive terminals A2 fixed in the insulating body A1, and a shielding casing A3 covering the insulating body A1. The plurality of conductive terminals A2 are formed on the insulating body A1 by injection molding. The insulating body A1 comprises a front surface A11, a rear surface A12, two side surfaces A13, a top surface A14, and a bottom surface A15. A tongue A16 protrudes forward from a center of the front surface A11. The tongue A16 comprises an upper surface A17 and a lower surface A18 opposite to each other. Each of two sides of the tongue A16 is vertically bent downward to extend a stop wall A19 so as to form an inverted U-shaped structure. Two fixing blocks A20 are respectively disposed on two sides of each of the top surface A14 and the rear surface A12 of the insulating body A1 and are configured to hold the shielding casing A3. In addition, the top surface A14, the bottom surface A15, and the two side surfaces A13 are respectively provided with small ribs A21 to generate an interference fit with the shielding casing A3, so that the shielding casing A3 and the insulating body A1 remain secure between one another. A rib A22 extends downward from a rear end of the bottom surface A15. Two positioning posts A23 extend downward from the bottom surface 15 in front of a front end of the rib A22, so that the electrical connector A10 is positioned on a circuit board. A plurality of stripping holes A24 are formed on each of the top surface A14 and the bottom surface A15 of the insulating body A1 to facilitate the flow of the insulating material, thus promoting the molding of the insulating body A1.

According to the Taiwanese patent No. M332299, since the stripping holes A24 are formed in a same row side by side, and at the same time are recessed into the top surface A14 and the bottom surface A15 of the insulating body A1, the conductive terminals A2 are partially exposed due to the stripping holes A24. As a result, the conductive terminals A2 can directly contact with air to improve the characteristic impedance of the conductive terminals A2. However, this tends to cause crosstalk interferences between the conductive terminals A2 because each two of the conductive terminals A2 have a high contact density with the air. As a result, the risk of poor overall high frequency environment is caused. It is therefore necessary to provide an improved design for the electrical connector A10 configured to transmit a high frequency electronic signal.

SUMMARY

One objective of the present invention is to provide a high frequency connector that can be configured to transmit a high frequency electronic signal. The high frequency connector is at least adapted to transmitting an electronic signal having a frequency up to millions of hertz (MHz).

In some embodiment of the present invention, a high frequency connector is provided. The high frequency connector comprises an insulating housing, a first insulating piece, a second insulating piece, a plurality of first terminals, and a plurality of second terminals. The plurality of first terminals are insert-molded in the first insulating piece. The plurality of second terminals are insert-molded in the second insulating piece. The first insulating piece and the second insulating piece are assembled to the insulating housing. Each of the first insulating piece and the second insulating piece has a first surface and a second surface. A plurality of recesses are formed on each of the first surface and the second surface. The recesses are arranged in parallel on each of the first surface and the second surface. A plurality of impedance adjustment holes are arranged on each of the first surface and the second surface in an interlaced manner. Each of the impedance adjustment holes is disposed between the recesses. Each of the impedance adjustment holes is constituted by a plurality of notches. The notches are arranged perpendicular to the recesses, and appropriate spacings are kept between the notches. Each of the first terminals and the second terminals is received in the impedance adjustment hole or the recess.

In some embodiment of the present invention, each of the first terminals and the second terminals has a fixed portion, and a contact portion and a soldering portion respectively extending outward from two sides of the fixed portion. The fixed portion is received respectively in the impedance adjustment hole or the recess. The contact portion is configured to be electrically connected to a docking connector. The soldering portion is soldered and fixed to a circuit board. Each of the plurality of first terminals and the plurality of second terminals has at least one pair of differential signal terminals immediately-adjacent to each other configured to transmit a differential electronic signal, and each of two opposing outer sides of the pair of differential signal terminals are immediately-adjacent to ground terminals. The ground terminals are positioned at the first insulating piece or the second insulating piece, and the ground terminals are received in the recess. The differential signal terminal pair is received in the impedance adjustment hole.

In some embodiment of the present invention, the plurality of first terminals are arranged in a row so that the plurality of first terminals can be insert-molded in the first insulating piece. Since the fixed portion of each of the first terminals is received in the recess or the impedance adjustment hole of the first insulating piece, the fixed portion of each of the first terminals can be partially exposed from the first surface or the second surface of the first insulating piece. As a result, part of the fixed portion of each of the first terminals can be in direct contact with air. The plurality of second terminals are arranged in a row so that the plurality of second terminals can be insert-molded in the second insulating piece. Since the fixed portion of each of the second terminals is received in the recess or the impedance adjustment hole of the second insulating piece, the fixed portion of each of the second terminals can be partially exposed from the first surface or the second surface of the second insulating piece. As a result, part of the fixed portion of each of the second terminals can be in direct contact with air. Because the dielectric coefficient of the air is less than dielectric coefficients of the first insulating piece and the second insulating piece, the plurality of first terminals and the plurality of second terminals have better high frequency characteristics through the impedance adjustment holes, which can effectively improve their characteristic impedance and crosstalk interference.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
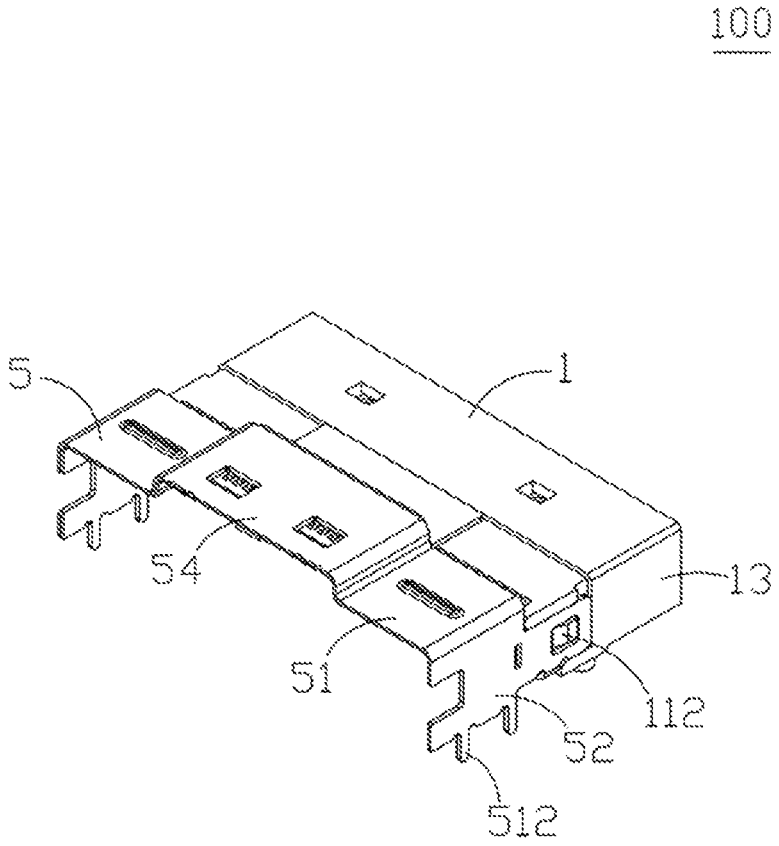
FIG. 1 depicts a three-dimensional view as viewed from a first angle according to some embodiments of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
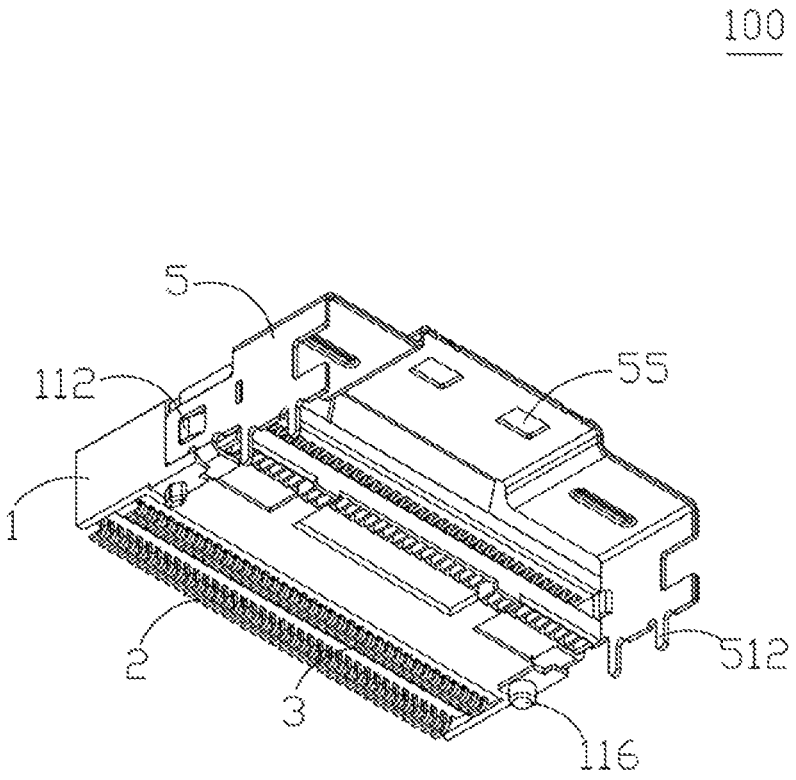
FIG. 2 depicts a three-dimensional view as viewed from a second angle according to some embodiments of the present invention.
Figure 3:
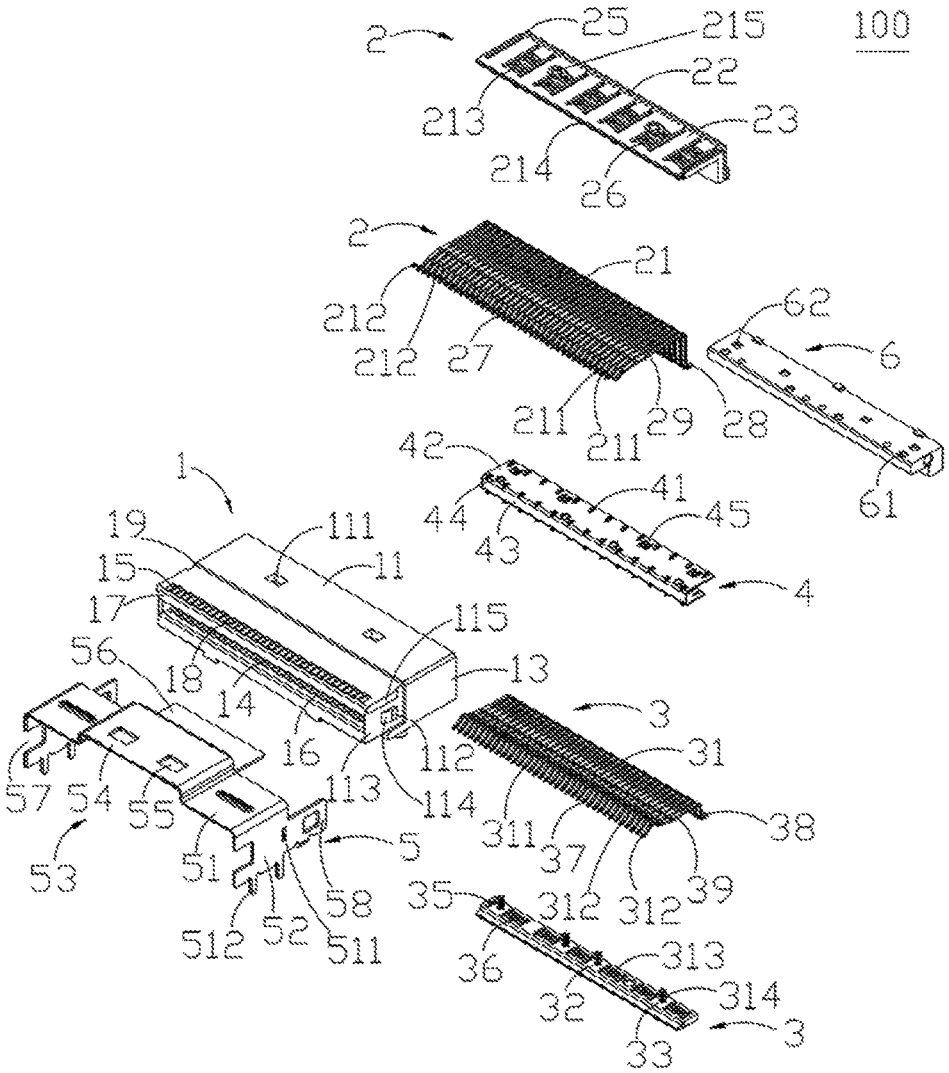
FIG. 3 depicts an exploded view as viewed from the first angle according to some embodiments of the present invention.
Figure 4:
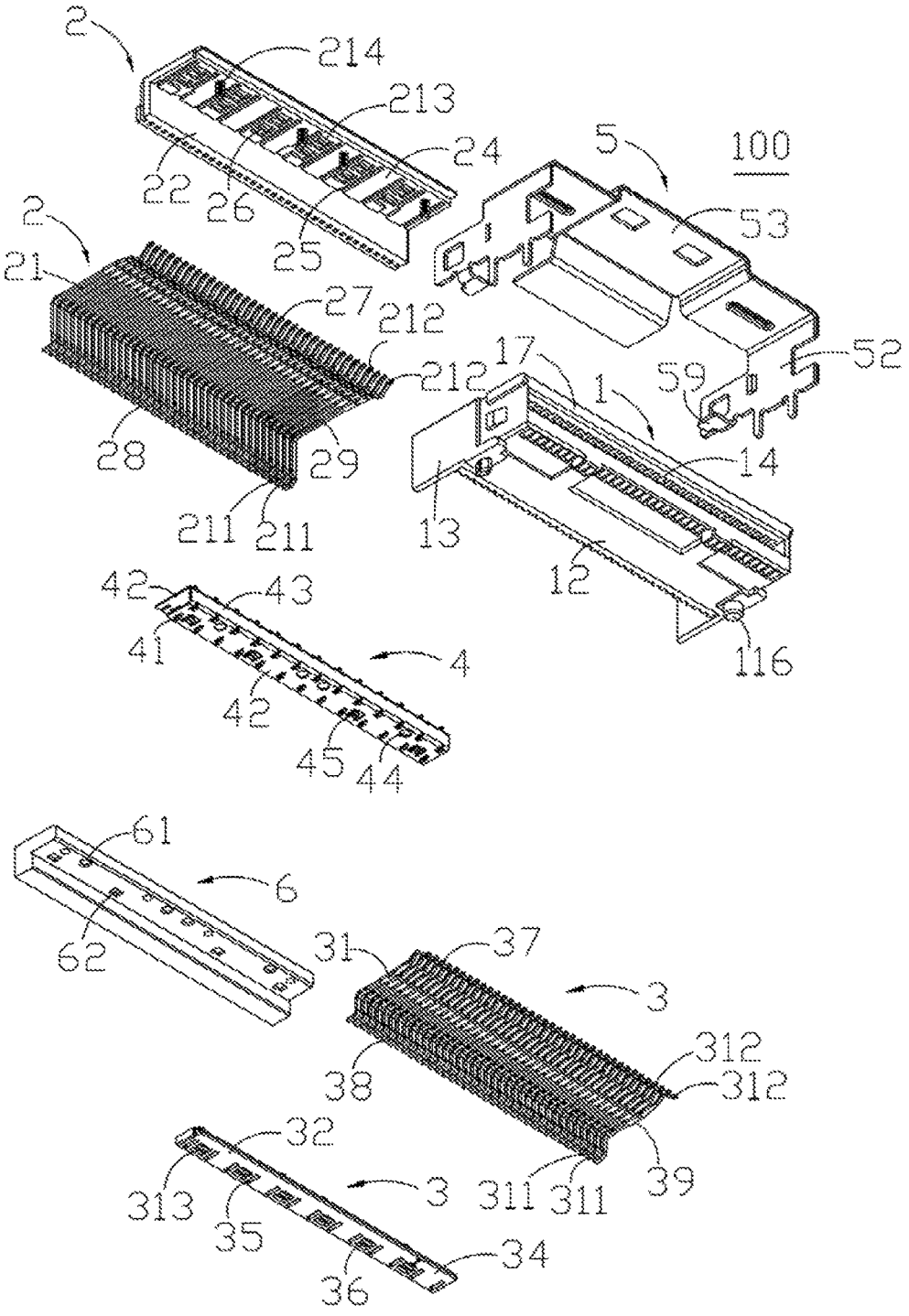
FIG. 4 depicts an exploded view as viewed from the second angle according to some embodiments of the present invention.
Figure 5:
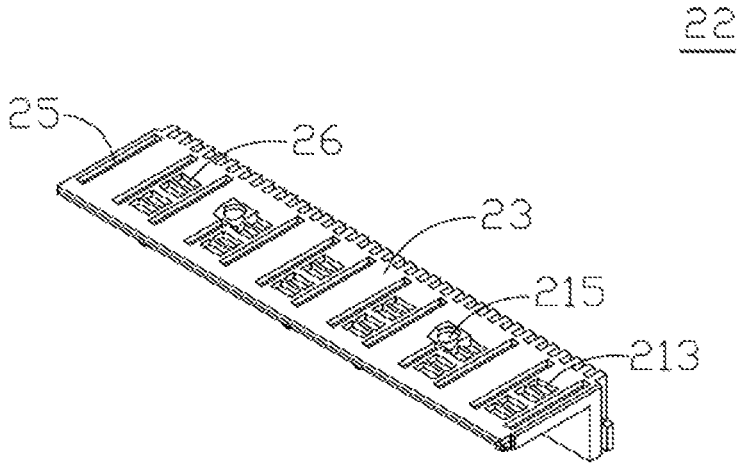
FIG. 5 depicts a three-dimensional view of a first insulating piece as viewed from the first angle according to the present invention.
Figure 6:
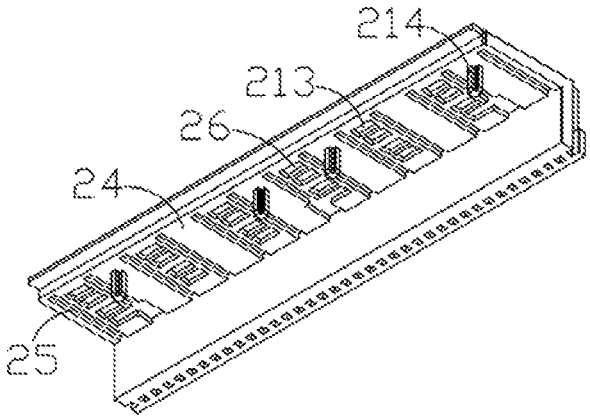
FIG. 6 depicts a three-dimensional view of the first insulating piece as viewed from the second angle according to the present invention.
Figure 7:
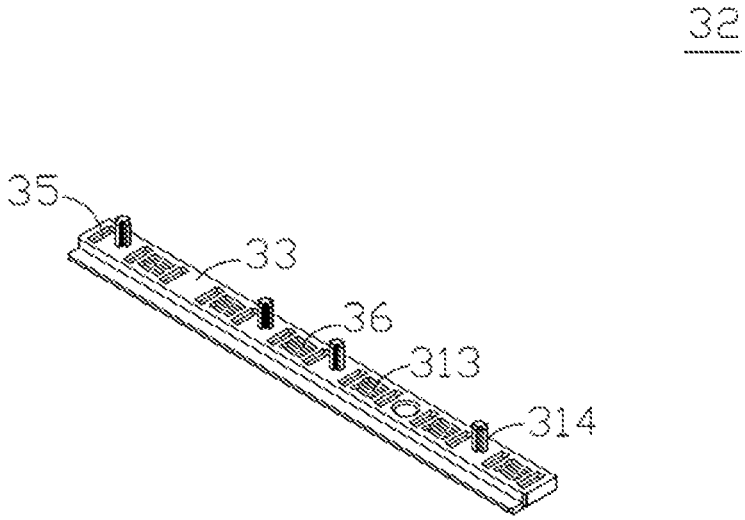
FIG. 7 depicts a three-dimensional view of a second insulating piece as viewed from the first angle according to the present invention.
Figure 8:
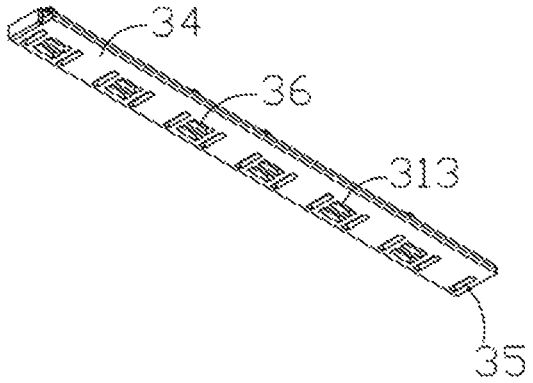
FIG. 8 depicts a three-dimensional view of the second insulating piece as viewed from the second angle according to the present invention.
Figure 9:
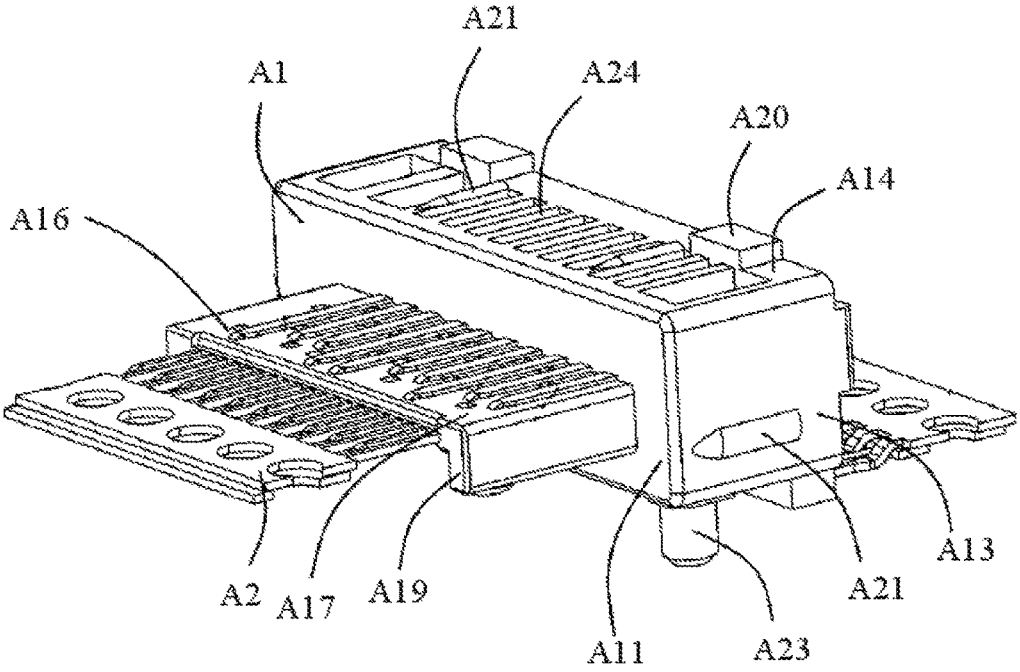
Fig. 9 ( PRIOR ART )
FIG. 9 depicts a three-dimensional view of an insulating body as viewed from a first angle according to the prior art Taiwan patent No. M332299.
Figure 10:
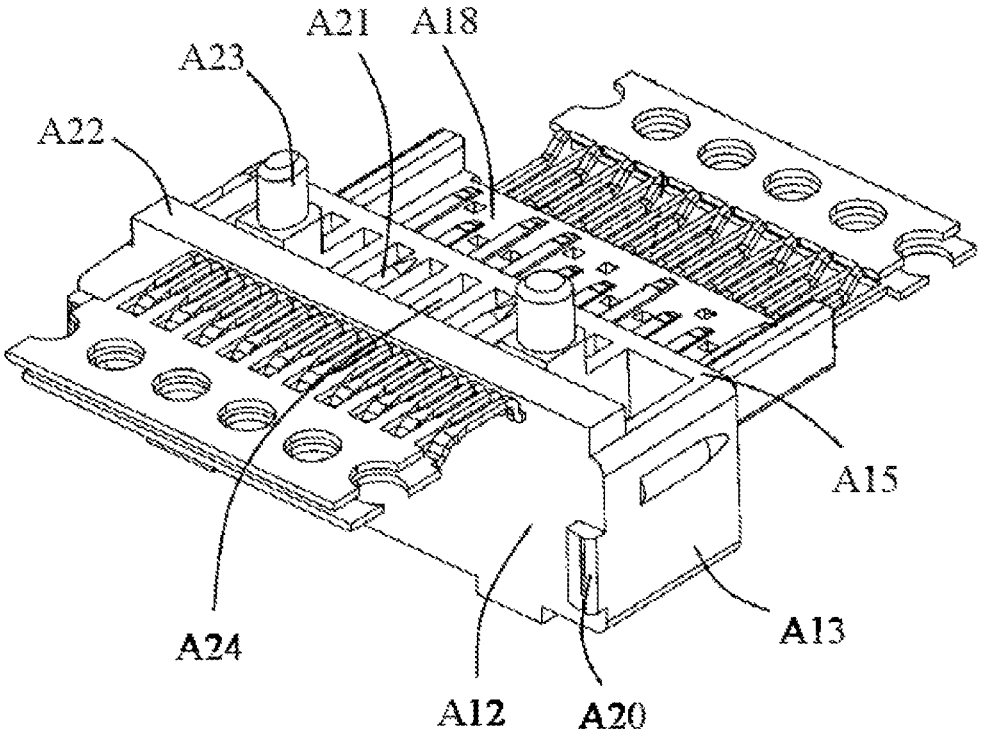
Fig. 10 ( PRIOR ART )
FIG. 10 depicts a three-dimensional view of the insulating body as viewed from a second angle according to the prior art Taiwan patent No. M332299.
Figure 11:
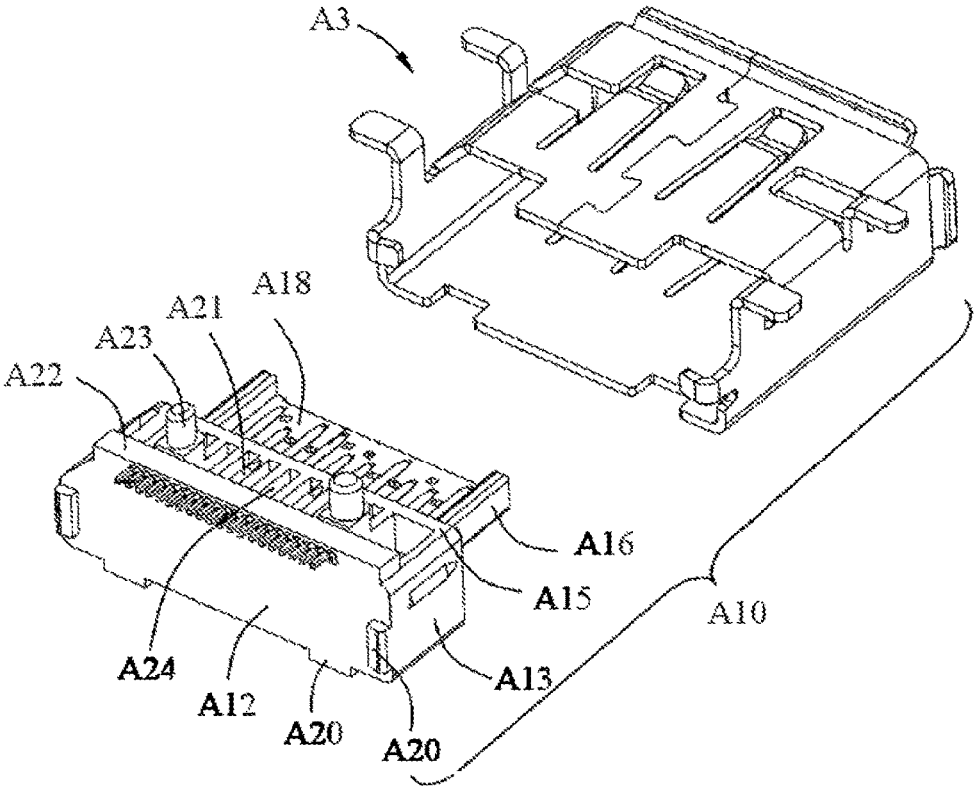
Fig. 11 ( PRIOR ART )
FIG. 11 depicts an exploded view according to the prior art Taiwan patent No. M332299.

As shown in FIG. 1 to FIG. 8, the Slim SAS (Serial Attached SCSI) connector standard established by the SAS association is taken as an example in some embodiments of the present invention, but the practical applications of the present invention are not limited in this regard. According to some embodiments of the present invention, a high frequency connector is disclosed. The high frequency connector 100 comprises an insulating housing 1, a first terminal set 2, a second terminal set 3, a metal plate 4, and a metal housing 5. The high frequency connector 100 may be fixed to a circuit board in an electronic device, and the high frequency connector 100 can transmit electronic signals between the circuit board and a docking device.

According to some embodiments of the present invention, the insulating housing 1 is formed by injection molding a plastic material. The insulating housing 1 comprises a top wall 11, a bottom wall 12, and two side walls 13. The top wall 11, the bottom wall 12, and the side walls 13 form a receiving slot 14. The receiving slot 14 is configured to accommodate part of the docking device. A plurality of spacers 15 are disposed on each of the top wall 11 and the bottom wall 12 and extend towards an opening of the receiving slot 14 to form a plurality of terminal slots 16, and the space of the receiving slot 14 comprises the terminal slots 16. A bearing plate 17 is disposed on each of the top wall 11 and the bottom wall 12 in the opening of the receiving slot 14 to cover these spacers 15. The bearing plates 17 are in parallel with the top wall 11 and the bottom wall 12. An opening 18 penetrating through the top wall 11 or the bottom wall 12 is formed in each of the terminal slots 16 adjacent to the opening of the receiving slot 14. The openings 18 are so designed to provide the terminal slots 16 with buffer space. A step 19 is disposed on the top wall 11 and each of the side walls 13 of the insulating housing 1 adjacent to the opening of the receiving slot 14, so that surfaces of the top wall 11 and the side walls 13 near the opening of the receiving slot 14 are lower than surfaces of the top wall 11 and the side walls 13 away from the opening of the receiving slot 14. A plurality of retaining holes 111 are disposed on the surface of the top wall 11. The retaining holes 111 are in a rectangular shape and penetrate through the top wall 11, and the retaining holes 111 are located away from the opening of the receiving slot 14. A projection portion 112 is disposed on each of the side walls 13 outside the opening of the receiving slot 14. Each of the projection portions 112 is located in a guide passage 113 and has an inclined plane 114 towards the opening of the receiving slot 14 to facilitate snap fitting. The guide passages 113 are located on outer surfaces of the side walls 13. Two projections 115 are respectively disposed at two ends of the side wall 13. The projections 115 are respectively adjacent to the top wall 11 and the bottom wall 12. An area between the two projections 115 is the guide passage 113. A guide direction of the guide passages 113 is in parallel with a docking direction of the opening of the receiving slot 14, and a plurality of pillars 116 in a circular shape or in a rectangular shape are disposed on a surface of the bottom wall 12. The pillars 116 can provide the effects of assembling and fixing.

According to some embodiments of the present invention, the first terminal set 2 has a plurality of first terminals 21 and a first insulating piece 22. The second terminal set 3 has a plurality of second terminals 31 and a second insulating piece 32. The plurality of first terminals 21 are insert-molded in the first insulating piece 22. The plurality of second terminals 31 are insert-molded in the second insulating piece 32. The first insulating piece 22 and the second insulating piece 32 are assembled to the insulating housing 1. The first insulating piece 22 has a first surface 23 and a second surface 24. A plurality of first recesses 25 are formed on each of the first surface 23 and the second surface 24. The first recesses 25 are arranged in parallel on the first surface 23 and the second surface 24. A plurality of first impedance adjustment holes 26 are arranged on each of the first surface 23 and the second surface 24 in an interlaced manner. Each of the first impedance adjustment holes 26 is disposed between each of the first recesses 25. Each of the first terminals 21 is received in the first impedance adjustment hole 26 or the first recess 25. The second insulating piece 32 has a third surface 33 and a fourth surface 34. A plurality of second recesses 35 are formed on each of the third surface 33 and the fourth surface 34. Each of the second recesses 35 are arranged in parallel on the third surface 33 and the fourth surface 34. A plurality of second impedance adjustment holes 36 are arranged on each of the third surface 33 and the fourth surface 34 in an interlaced manner. Each of the second impedance adjustment holes 36 is disposed between each of the second recesses 35. Each of the second terminals 31 is received in the second impedance adjustment hole 36 or the second recess 35.

According to some embodiments of the present invention, each of the first terminals 21 comprises a first contact portion 27, a first soldering portion 28, and a first fixed portion 29 that connects the first contact portion 27 and the first soldering portion 28. Each of the first fixed portions 29 is received in the first impedance adjustment hole 26 or the first recess 25. The first contact portion 27 is configured to be electrically connected to a docking connector. The first soldering portion 28 is soldered and fixed to a circuit board. The plurality of first terminal 21 are arranged in a row so that the plurality of first terminals 21 can be insert-molded in the first insulating piece 22. Since the first fixed portion 29 of each of the first terminals 21 is received in the first recess 25 or the first impedance adjustment hole 26, the first fixed portion 29 of each of the first terminals 21 can be partially exposed from the first surface 23 and the second surface 24 of the first insulating piece 22. As a result, part of the first fixed portion 29 of each of the first terminals 21 can be in direct contact with air. Because the dielectric coefficient of the air is less than a dielectric coefficient of the first insulating piece 22, and the first impedance adjustment holes 26 are arranged on the first surface 23 or the second surface 24 in an interlaced manner, the plurality of first terminals 21 disperse part of the electromagnetic noise by using the first impedance adjustment holes 26. The plurality of first terminals 21 thus have better high frequency characteristics, which can effectively improve their characteristic impedance and crosstalk interference. Each of the second terminals 31 comprises a second contact portion 37, a second soldering portion 38, and a second fixed portion 39 that connects the second contact portion 37 and the second soldering portion 38. Each of the second fixed portions 39 is received in the second impedance adjustment hole 36 or the second recess 35. The second contact portion 37 is configured to be electrically connected to a docking connector. The second soldering portion 38 is soldered and fixed to a circuit board.

According to some embodiments of the present invention, the plurality of second terminals 31 are arranged in a row so that the plurality of second terminals 31 can be insert-molded in the second insulating piece 32. Since the second fixed portion 39 of each of the second terminals 31 is received in the second recess 35 or the second impedance adjustment hole 36, the second fixed portion 39 of each of the second terminals 31 can be partially exposed from the third surface 33 or the fourth surface 34 of the second insulating piece 32. As a result, part of the second fixed portion 39 of each of the second terminals 31 can be in direct contact with air. Because the dielectric coefficient of the air is less than a dielectric coefficient of the second insulating piece 32, the plurality of second terminals 31 thus have better high frequency characteristics, which can effectively improve their characteristic impedance and crosstalk interference.

According to some embodiments of the present invention, the plurality of first terminals 21 have at least one first pair of differential signal terminals 211 immediately-adjacent to each other and at least one first ground terminal 212 respectively. The plurality of second terminals 31 have at least one second pair of differential signal terminals 311 immediately-adjacent to each other and at least one second ground terminal 312 respectively. The first pair of differential signal terminals 211 and the second pair of differential signal terminals 311 are configured to transmit differential electronic signals. Each of two outer sides of the first pair of differential signal terminals 211 are adjacent to the first ground terminal 212. Each of two outer sides of the second pair of differential signal terminals 311 are adjacent to the second ground terminals 312. The first ground terminals 212 are configured to be fixed to the first insulating piece 22 and are joined to a plurality of contact arms 41 disposed on the metal plate 4. The second ground terminals 312 are configured to be fixed to the second insulating piece 32 and are joined to the plurality of contact arms 41 disposed on the metal plate 4. In addition, the first ground terminal 212 is received in the first recess 25. The second ground terminal 312 is received in the second recess 35. Each of the first pair of differential signal terminals 211 are received in the first impedance adjustment hole 26. Each of the second pair of differential signal terminals 311 are received in the second impedance adjustment hole 36. The first impedance adjustment hole 26 is constituted by a plurality of first notches 213. The second impedance adjustment hole 36 is constituted by a plurality of second notches 313. The first notches 213 are arranged perpendicular to the first recesses 25. The second notches 313 are arranged perpendicular to the second recesses 35. Appropriate spacings are kept between the first notches 213. Appropriate spacings are kept between the second notches 313. The first notches 213 expose part of the first pair of differential signal terminals 211 of the first terminals 21. The second notches 313 expose part of the second pair of differential signal terminals 311 of the second terminals 31. Surfaces of the first fixed portion 29 of each of the first ground terminals 212 and the second fixed portion 39 of each of the second ground terminals 312 are coated with solder. Each of the first pair of differential signal terminals 211 and the second pair of differential signal terminals 311 can be used for transmitting a high frequency signal. Each of the first ground terminals 212 and each of the second ground terminals 312 are joined to the contact arms 41 of the metal plate 4 so that each of the first ground terminals 212 and each of the second ground terminals 312 generate a ground effect.

According to some embodiments of the present invention, the first insulating piece 22 and the second insulating piece 32 respectively encapsulate the plurality of first terminals 21 and the plurality of second terminals 31 by using insert molding to form the first terminal set 2 and the second terminal set 3. The first insulating piece 22 and the second insulating piece 32 are made of a plastic material and can be respectively insulated from the first terminal 21 and the second terminals 31. A plurality of first protrusions 214 are disposed on the first insulating piece 22. A plurality of second protrusions 314 are disposed on the second insulating piece 32. The first protrusions 214 of the first insulating piece 22 and the second protrusions 314 of the second insulating piece 32 extend in the direction against each other and are perpendicular to surfaces of the first insulating piece 22 and the second insulating piece 32. The shape of the first insulating piece 22 of the first terminal set 2 matches the shape of the second insulating piece 32 of the second terminal set 3, and the first protrusions 214 and the second protrusions 314 are arranged in an interlaced manner when being matched to allow the first terminal set 2 and the second terminal set 3 to be combined with each other.

According to some embodiments of the present invention, the first terminal set 2 and the second terminal set 3 respectively have at least one first pair of differential signal terminals 211 immediately-adjacent to each other and at least one second pair of differential signal terminals 311 immediately-adjacent to each other. Because the first pair of differential signal terminals 211 and the second pair of differential signal terminals 311 transmit the differential electronic signals, and the two outer sides of the first pair of differential signal terminals 211 and the two outer sides of the second pair of differential signal terminals 311 are respectively adjacent to the first ground terminals 212 and the second ground terminals 312, an arrangement of ground terminal-signal terminal-signal terminal-ground terminal (G-S-S-G) is formed. The first ground terminals 212 and the second ground terminals 312 adjacent to two sides of the first pair of differential signal terminals 211 and two sides of second pair of differential signal terminals 311 can ground the interferences and noises generated by the differential signal terminals when transmitting high frequency differential signals. As a result, interferences caused by the first pair of differential signal terminals 211 and the second pair of differential signal terminals 311 to the other signal terminals can be effectively reduced when transmitting the high frequency signals.

According to some embodiments of the present invention, the first notches 213 of the first insulating piece 22 expose the first pair of differential signal terminals 211 of the first terminals 21, so that the first pair of differential signal terminals 211 are in contact with air. Since the dielectric coefficient of the air is less than the dielectric coefficient of the first insulating piece 22, and the first pair of differential signal terminals 211 are partially exposed to the air when the high frequency signal is transmitted, factors influencing the first insulating piece 22 can be effectively reduced to adjust the impedance value of the first pair of differential signal terminals 211. The first pair of differential signal terminals 211 thus have better high frequency characteristics.

According to some embodiments of the present invention, the metal plate 4 is made of a conductive material, and a surface of the metal plate 4 is coated with solder. The metal plate 4 is bent to have a pair of flat plates 42, a connecting plate 43, and the plurality of contact arms 41. The flat plates 42 respectively extend from two sides of the connecting plate 43. Each of the flat plates 42 is perpendicular to the connecting plate 43, and a hole 44 is formed on a surface of each of the flat plate 42 and penetrates through the each of the flat plate 42. The contact arms 41 extend outward from two sides of each of the flat plates 42. The contact arms 41 have elasticity, and the metal plate 4 may be formed by using punching, cutting, bending, etc.

According to some embodiments of the present invention, an insulator 6 is formed by injection molding a plastic material. The insulator 6 is sandwiched between the pair of flat plates 42 of the metal plate 4. A plurality of through holes 61 are formed on two opposite surfaces and a plurality of depressed portions 62 are disposed on the two opposite surfaces of the insulator 6. The flat plates 42 are respectively held on the two opposite surfaces of the insulator 6. The holes 44 of the flat plates 42 overlap the through holes 61 of the insulator 6. At least one holding portion 45 is disposed at a position of the metal plate 4 corresponding to the depressed portion 62. The at least one holding portion 45 has an elastic bend. The depressed portions 62 can provide buffer space for receiving the at least one holding portion 45.

According to some embodiments of the present invention, the metal housing 5 is formed from a metal sheet. The metal housing 5 comprises a top plate 51 and a pair of side plates 52. The side plates 52 respectively extend from two opposite sides of the top plate 51. Each of the side plates 52 extend in a same direction to form an accommodation space 53. A joint portion 54 is disposed on the top plate 51. The joint portion 54 is formed from the top plate 51 raising away from the accommodation space 53, and a plurality of docking holes 55 are formed in the joint portion 54 for fixing a docking device (not shown in the figure). A covering portion 56 extends from the joint portion 54. A third recess 57 is formed at one edge of each of the side plates 52, and a lug 58 extends from another edge opposite to the third recess 57. An engagement element 59 extends from one side of each of the lugs 58. A protective structure 511 is disposed where the lug 58 extends from each of the side plates 52. The protective structures 511 are protrusions extending from the side plates 52 towards the accommodation space 53. The protective structures 511 can effectively protect the insulating housing 1 and prevent the insulating housing 1 from being damaging, and a plurality of pins 512 extend from one edge of each of the side plates 52.

According to some embodiments of the present invention, the first protrusions 214 and the second protrusions 314 of the first insulating piece 22 and the second insulating piece 32 are respectively assembled to the holes 44 of the metal plate 4 and the through holds 61 of the insulator 6 that overlap each other. By using the first protrusions 214 and the second protrusions 314, the insulator 6 and the metal plate 4 are mounted between the first terminal set 2 and the second terminal set 3. The flat plates 42 of the metal plate 4 are respectively adjacent to the first terminal set 2 and the second terminal set 3. Each of the contact arms 41 of the metal plate 4 extends towards the first ground terminal 212 and the second ground terminal 312 respectively. The contact arms 41 near the first insulating piece 22 contact and are electrically connected to the first fixed portions 29 of the first ground terminals 212 through the first recesses 25 in the first insulating piece 22. The contact arms 41 near the second insulating piece 32 contact and are electrically connected to the second fixed portions 39 of the second ground terminals 312 through the second recesses 35 in the second insulating piece 32. Since the metal plate 4 is electrically connected to each of the first ground terminals 212 and the second ground terminals 312, the first ground terminals 212 and the second ground terminals 312 are electrically connected to each other through the metal plate 4. When one of the first ground terminals 212 and the second ground terminals 312 receives a large amount of signal interference, the interference signal can be transmitted to the first ground terminals 212 and the second ground terminals 312 other than the one of the first ground terminals 212 and the second ground terminals 312 by using the metal plate 4. The noise is thus rapidly grounded to avoid the interference between the signal terminals when transmitting the high frequency signal, thus improving the signal transmission quality.

According to some embodiments of the present invention, at least one retaining structure 215 is disposed on the first insulating piece 22. The at least one retaining structure 215 is fixed in the retaining holes 111 of the insulating housing 1, so that the first insulating piece 22 of the first terminal set 2 and the second insulating piece 32 of the second terminal set 3 are fixed to a position within the insulating housing 1. The first terminals 21 of the first terminal set 2 and the second terminals 31 of the second terminal set 3 are indirectly positioned in the insulating housing 1.

According to some embodiments of the present invention, a front edge of the first contact portion 27 of the first terminal 21 exerts a force to the bearing plate 17. The front edge of each of the first contact portions 27 is restricted by the bearing plate 17. Hence, the first contact portions 27 can only elastically deform in a direction opposite to the bearing plate 17. As a result, the first contact portions 27 receive a pre-load provided by the bearing plate 17 when the first contact portions 27 are not plugged into a docking device (not shown in the figure). When the high frequency connector 100 is plugged into a docking device (not shown in the figure), the first contact portions 27 of the first terminals 21 are able to output a larger normal force, so that the signal transmission of the first terminals 21 is more stable.

According to some embodiments of the present invention, the lugs 58 extending from the side plates 52 of the metal housing 5 are respectively engaged with the projection portions 112 of the side walls 113 of the insulating housing 1. The lugs 58 accurately contact the projection portions 112 along the guide passages 113. Through the guidance of the inclined planes 114 of the projection portions 112, the lugs 58 hook the projection portions 112. Each of the protective structures 511 of the metal housing 5 is disposed at the opening of the receiving slot 14 of the insulating housing 1 and is adjacent to each of the side walls 13. The protective structures 511 can be configured to guide a plugging direction of a tongue plate (not shown in the figure) of the docking device (not shown in the figure) so that the tongue plate (not shown in the figure) can be smoothly plugged into the receiving slot 14 of the insulating housing 1. The tongue plate (not shown in the figure) may be a circuit board. The protective structures 511 can effectively prevent the tongue plate from scratching the insulating housing 1 to increase the service life of the high frequency connector 100. The covering portion 56 extending from the joint portion 54 of the metal housing 5 adheres to the top wall 11 of the insulating housing 1 and abuts against the step 19 on the top wall 11, and the metal housing 5 forms an accommodation space 53 that communicates with the receiving slot 14 of the insulating housing 1. The scope of the present invention is not limited to the metal housing 5, and the insulating housing 1, the first terminal set 2, the second terminal set 3, the metal plate 4, and the insulator 6 may be combined to form another embodiment.

According to some embodiments of the present invention, the high frequency connector 100 is fixed to the circuit board (not shown in the figure) through a heating method, such as a reflow soldering process, after the high frequency connector 100 is assembled. The circuit board (not shown in the figure) has a plurality of soldering points (not shown in the figure) on it. The soldering points (not shown in the figure) are coated with solder. The first soldering portions 28 of the first terminals 21 of the high frequency connector 100 are respectively aligned with the soldering points (not shown in the figure). When soldering, the temperature rises to a point where the solder melts, and the solder fills up joint surfaces of the first soldering portions 28 and the soldering points. After the temperature is lowered, the solder fixes the first soldering portions 28 of the high frequency connector 100 to the soldering points (not shown in the figure) of the circuit board (not shown in the figure) and the first soldering portions 28 are electrically connected to the soldering points. Because an overall temperature of the high frequency connector 100 also rises during the heating process, solder on surfaces where the contact arms 41 of the metal plate 4 contact the first fixed portions 29 of the first ground terminals 212 melts and the contact arms 41 and the first fixed portions 29 are jointed to each other. As a result, at least one of the contact arms 41 of the metal plate 4 is soldered to the first fixed portion 29 of the first ground terminal 212 of the first terminal set 2. After cooling, the contact arms 41 of the metal plate 4 and the first fixed portions 29 of the first ground terminals 212 are soldered and fixed to each other by using the solder, and the electrical connection characteristics are improved. Hence, the metal plate 4 is fixed to a position within the insulating housing 1 through the first ground terminal(s) 212 and the first insulating piece 22 of the first terminal set 2. By using the heating and cooling process, the high frequency connector 100 is fixed to the circuit board (not shown in the figure) and at the same time the contact arms 41 are soldered to the first ground terminals 212 to simplify the process steps, thus increasing the production efficiency.

According to some embodiments of the present invention, the first fixed portions 29 of the first ground terminals 212 of the first terminal set 2 contact and are electrically connected to the contact arms 41 of the metal plate 4, respectively. The contact arms 41 provide an elastic force to each of the first ground terminals 212. The first ground terminals 212 also provide a reaction force to each of the contact arms 41. A surface where the first ground terminal 212 contacts the contact arm 41 forms a contact surface. However, the electrical connection provided by a physical contact will have different impedances or even have poor contact due to a different contact area caused by uneven roughness of the contact surface or a deviation of a contact angle. In order to overcome this problem and improve the ground effect and stability, the first ground terminals 212 and the metal plate 4 are coated with solder before being assembled. The soldering process is not limited to electroplating, vapor deposition, or sputter, etc. When the first ground terminals 212 are assembled with and contact the contact arms 41, a heating process is performed so that the solder between the first ground terminals 212 and the contact arms 41 melt and fills up the contact surfaces. After cooling, the first ground terminals 212 and the contact arms 41 are connected through the solder to effectively improve the electrical connection characteristics, thus eliminating concerns about poor contact.

As compared with the prior art, the plurality of terminals according to some embodiments of the present invention are arranged in a row. Hence, the plurality of terminals can be insert-molded in the insulating piece. Since the fixed portion of each of the terminals is received in the recess or the impedance adjustment hole, the fixed portion of each of the terminals can be partially exposed from the upper surface and the lower surface of the insulating piece. As a result, part of the fixed portion of each of the terminals can be in direct contact with the air. Because the dielectric coefficient of the air is less than the dielectric coefficient of the insulating piece, the plurality of terminals have better high frequency characteristics, which can effectively improve their characteristic impedance and crosstalk interference. The interference problem existing when the high frequency connector transmits the high frequency signal can be avoided, so as to increase the signal transmission efficiency.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A high frequency connector comprising: an insulating housing, a first insulating piece, a second insulating piece, a plurality of first terminals, and a plurality of second terminals, the plurality of first terminals being insert-molded in the first insulating piece, the plurality of second terminals being insert-molded in the second insulating piece, the first insulating piece and the second insulating piece being assembled to the insulating housing, characterized in that: each of the first insulating piece and the second insulating piece having a first surface and a second surface, a plurality of recesses being formed on each of the first surface and the second surface, the recesses being arranged in parallel on each of the first surface and the second surface, a plurality of impedance adjustment holes being arranged on each of the first surface and the second surface in an interlaced manner, the impedance adjustment holes being disposed between the recesses, each of the impedance adjustment holes being constituted by a plurality of notches, the notches being arranged perpendicular to the recesses, and spacings being kept between the notches, each of the first terminals and the second terminals being received in a corresponding one of the impedance adjustment holes or the recesses.

2. The high frequency connector of claim 1, wherein each of the first terminals and the second terminals has a fixed portion, and a contact portion and a soldering portion extending outward from two sides of the fixed portion respectively, the fixed portion is received in a corresponding one of the impedance adjustment holes or the recesses.

3. The high frequency connector of claim 1, wherein the plurality of first terminals and the plurality of second terminals each has at least one pair of differential signal terminals immediately-adjacent to each other configured to transmit a differential electronic signal, two opposing outer sides of the pair of differential signal terminals are immediately-adjacent to ground terminals.

4. The high frequency connector of claim 3, wherein the ground terminals are received in a corresponding one of the recesses, and the pair of differential signal terminals are received in a corresponding one of the impedance adjustment holes.

5. The high frequency connector of claim 2, wherein the plurality of first terminals are arranged in a row, whereby the fixed portion of each of the first terminals is partially exposed from the first surface or the second surface of the first insulating piece.

* * * * *